343-700 MS AU 251 EX
10/13/87 OR 4,700,194

United States Patent [19]

Ogawa et al.

[11] Patent Number: 4,700,194

[45] Date of Patent: Oct. 13, 1987

[54] SMALL ANTENNA

[75] Inventors: Koichi Ogawa, Kyoto; Tomoki Uwano; Hiroaki Kosugi, both of Hirakata; Junko Yamamoto, Okayama, all of Japan

[73] Assignee: Matsushita Electric Industrial Co., Ltd., Osaka, Japan

[21] Appl. No.: 776,960

[22] Filed: Sep. 17, 1985

[30] Foreign Application Priority Data

Sep. 17, 1984 [JP] Japan ..... 59-194225

[51] Int. Cl.[4] ..... H01Q 1/36; H01Q 1/48; H01Q 9/28

[52] U.S. Cl. ..... 343/700 MS; 343/700 R; 343/848

[58] Field of Search ..... 343/700 MS, 700 R, 705, 343/745, 767, 772–775, 712, 780, 702, 845–848

[56] References Cited

PUBLICATIONS

"IEEE Transactions on Antennas and Propagation", vol. AP-27, No. 6, Nov. 1979, pp. 850–853.

Antennas—Theory and Practice, Schelkunoff and Friis, Ch. 15, pp. 474–477.

IEEE Transactions on Antennas and Propagation, vol. AP-29, No. 1, Jan. 1981; pp. 1–22.

*Primary Examiner*—Marvin L. Nussbaum

*Attorney, Agent, or Firm*—Wenderoth, Lind & Ponack

[57] ABSTRACT

A small antenna comprising a dielectric substrate, a radiation element provided on one major surface of the dielectric substrate, a ground element provided on the other major surface of the dielectric substrate. A feed point on the ground element is located at a position where a voltage of a standing voltage wave induced on the ground element becomes minimum. The antenna may be further provided with a short-circuit element for electrically connecting one ends of the radiation and ground elements.

16 Claims, 6 Drawing Figures

SMALL ANTENNA

BACKGROUND OF THE INVENTION

1. Field of The Invention

The present invention relates to an antenna for transmitting and/or receiving electromagnetic radiation, and more particularly to an antenna which is suitable to be used for portable radio equipment.

2. Description of The Prior Art

In recent times there has been significant development in portable radio equipment such as paging systems and land mobile radio systems, etc. With the advances of technologies in this field, demand for small antennas which are suitable to be used for such equipment has been increasing. In order to design the antenna for portable radio equipment, four factors given below are the important factors which should be taken into account.

(1) Little degradation of the input impedance and gain characteristic when the antenna is placed near an electric circuit and a human body;

(2) Good electrical isolation between the antenna and the ground circuit of a transmission line or an electric circuit so that the antenna current should not flow on the ground circuit and the case of the equipment;

(3) High gain and omnidirectional radiation pattern in the horizontal plane; and (4) Small size, light weight and firm structure.

Among these factors, factor (1) is particularly important in the case when the antenna is to be used as a build-in type.

External sleeve antenna are usually used with portable radio equipment. This kind of antenna is disclosed in S. A. Schelkunoff, H. T. friis: "Antennas Theory and Practice" John Wiley & Sons (1952). The sleeve antenna is featured by its good electrical isolation between the antenna and the ground circuit of a coaxial transmission line and an electric circuit, where the coaxial line is used to convey energy from the transmitter to the antenna or from the antenna to the receiver. A quater-wave trap, which is often called "balun" or "Sperrtopf", is used at a feed point of this kind of antenna. The sleeve antenna can be considered as a modification of a simple quater-wave monopole antenna, so that the parastic current on the outer surface of the outer conductor of the coaxial transmission line is reduced or eliminated by means of a quater-wave trap. Due to the above unique characteristics, the sleeve antenna shows fairly good performance as an external antenna for portable radio equipment. However, the antenna has to be more than one-half wavelength long, and the input impedance and gain characteristic of the antenna are easy to degrade due to access of an electric circuit and a human body to the antenna. Therefore, the sleeve antenna is not suitable as a build-in antenna for portable radio equipment. On the other hand, an antenna having a microstrip configulation is very attractive as a build-in antenna for portable radio equipment, because it is very small in size, simple form of low-plofile in shape and firm in structure. This kind of antenna is disclosed in IEEE Transactions on Antenna and Propagation, vol. AP-29, No. 1, pp. 1–183, January 1981. In this article, FIG. 5 on page 6 shows a basic structure of a rectangular microstrip antenna. This microstrip antenna has a sandwitch structure of two parallel conducting layers separated by a single thin dielectric substrate. The lower conductor functions as a ground plane, and the upper conductor may be a simple resonant rectangular patch. The ground plane is considered as a electrically conducting plate which is extended in X-Y plane infinitely or which has a large size relative to the wavelength of signal. As an antenna for a portable radio equipment, the ground plane has to be practically as small as possible, and may be required to have almost the same size as the resonant rectangular patch. In this situation, however, the ground element no longer acts as the "ground" on which a constant potential voltage should be maintained, but a sinusoidal variation of a voltage distribution is produced on the ground plane. Therefore, if a coaxial transmission line is used to transfer signals between the antenna and the equipment, a parastic current is generally induced on the outer conductor of the coaxial transmission line. Under this condition, the transmission line acts as a part of antenna element. As a result, the characteristics of the antenna such as the input impedance, radiation pattern and gain will change easily under actual usage conditions.

SUMMARY OF THE INVENTION

An object of the present invention is to provide a small antenna which shows electrically good isolation between the antenna and a ground circuit of a transmission line and an electric circuit so that the antenna current should not flow on the ground circuit and the case of the equipment without any quater-wave trap or balun at a feed point.

Another object of the present invention is to provide a small antenna whose input impedance and gain characteristic are hardly degraded due to access of an electric circuit and a human body to the antenna.

A further object of the present invention is to provide a small antenna which is small in size, light in weight and high in gain so as to be suitable to be used for portable radio equipment.

These objects are accomplished by an antenna comprising: a dielectric substrate; a radiation element provided on one major surface of the dielectric substrate; a ground element provided on the other major surface opposite to the one major surface of the dielectric substrate; first feed means provided at a first feed point on the radiation element for electrically connecting the radiation element with a signal line of a transmission line; and second feed means provided at a second feed point on the ground element for electrically connecting the ground element with a ground line of the transmission line, the second feed point being located at a position where a voltage of a standing voltage wave induced on the ground element becomes minimum. Each of the radiation and ground elements may be a conductive film coated on each major surface of the dielectric substrate.

The most important feature of the antenna according to the present invention is the position of the second feed point on the ground element. In the conventional microstrip antenna, the ground plane no longer acts as the "ground" in the case when the dimensions of the ground plane is relatively small compared to a wavelength of the signal to be transmitted. In this case, a sinusoidal variation of a voltage distribution, or a standing voltage wave is induced on the ground plane. As a result, a parastic current is induced on the outer conductor of the coaxial transmission line.

According to the present invention, the outer conductor of a transmission line is connected to the ground element at the second feed point where the voltage of the standing voltage wave induced on the ground element becomes minimum. With this structure, the parastic current on the transmission line can be reduced or eliminated without any quater-wave trap which is used in the conventional sleeve antenna configulation.

Each of the radiation element and the ground element of the antenna according to the present invention may be constructed in the shape of either rectangle or another shape such as a circle or an ellipse. When each of the ground element and the radiator element is a rectangle in shape, the second feed point is preferably at a position apart by electrically an odd multiple of one-quarter wavelength from an end of the rectangle ground element. In this case, the length of the rectangular radiation element may preferably be selected to be electrically one-half wavelength long to radiate electromagnetic energy efficiently.

The antenna according to the present invention may preferably further comprise short-circuit means which comprises a single thin conductive film or a plurality of conducting pins or via holes for electrically connecting an end of theradiation element with an end of the ground element. When each of the ground element and radiator element is a rectangle in shape, the second feed point is preferably at a position apart by electrically an odd multiple of one-quarter wavelength from the end connected with the short-circuit means. In this case, the length of the rectangular radiation element may be selected to be electrically one-quarter wavelength long to radiate electromagnetic energy efficiently. This type of antenna has a feature that can offer a further smaller antenna because the length of the radiation element is one-quarter wavelength rather than one-half wavelength.

According to the present invention, by selecting a proper location of the second feed point, a parastic current which flows on the transmission line can be reduced considerably. Further, the antenna according to the present invention provides a nearly omnidirectional radiation pattern in the horizontal plane with a front gain of at least −2dBd. It will be appreciated that the small antenna according to the present invention provides an antenna which is easily impedance matched to a transmission line without a quaterwave trap or an impedance matching network. Furthermore, the present invention provides an antenna which has a simple-form, firm and low-profile structure, and is particularly suited for use as a build-in antenna for portable radio equipment such as paging systems and cordless telephones.

The above and other objects, features and advantages will become more apparent from the following description of preferred embodiments taken in connection with the accompanying drawings in which:

BRIEF DESCRIPTION OF THE DRAWINGS .

Referring to FIG. 1, an antenna 10 comprises a rectangular dielectric substrate 21, a radiation element 23 provided on one major surface of the dielectric substrate 21, a ground element 2 provided on the other major surface of the dielectric substrate 21, and a short-circuit element provided on a rear end surface of the dielectric substrate 21 for electrically connecting respective ends of the radiation element 23 and the ground element 22. The radiation element 23 and the ground element 22 are disposed parallel to each other through the dielectric substrate 21 therebetween. In FIG. 1, the thickness of the dielectric substrate 21, radiation and ground elements 23 and 22, and the short-circuit element 24 are exaggerated than the actual sizes. The actual thickness of the dielectric substrate 21 is so designed to be adequately thin relative to the signal wavelength. The radiation element 23, the ground element 22 and the short-circuit element 24 may be a metal film coated on the respective surfaces of the dielectric substrate 21. Reference numeral 203 shows a feed point on the radiation element 23.

Figure 1:
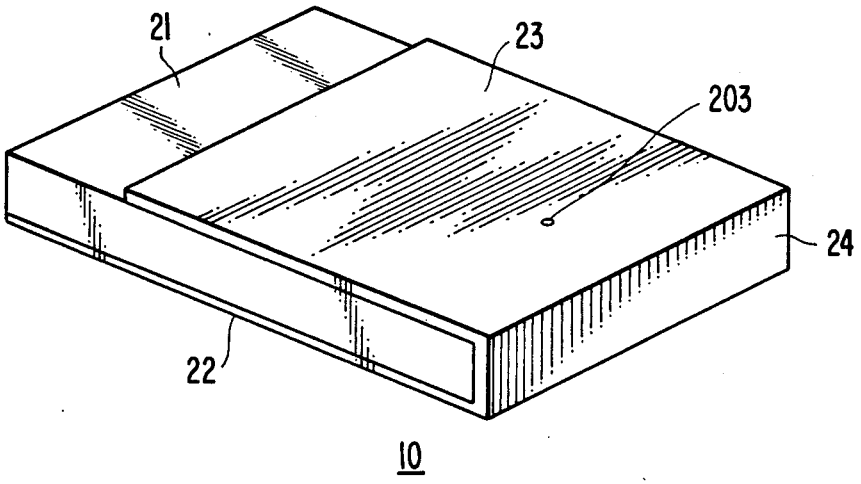
FIG. 1 is a perspective view of an embodiment of an antenna according to the present invention, having a conductive short-circuit film.
Figure 2A:
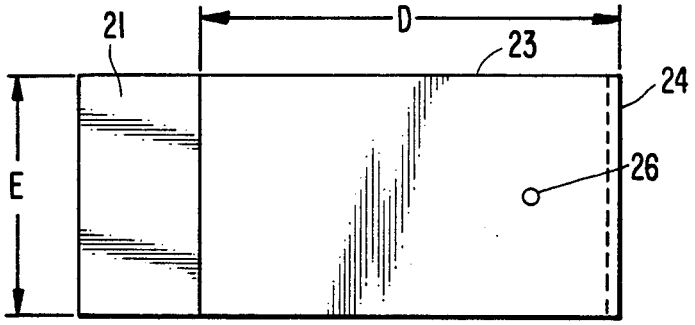
FIG. 2 shows a plan view and a side view of the embodiment of FIG. 1.
Figure 2B:
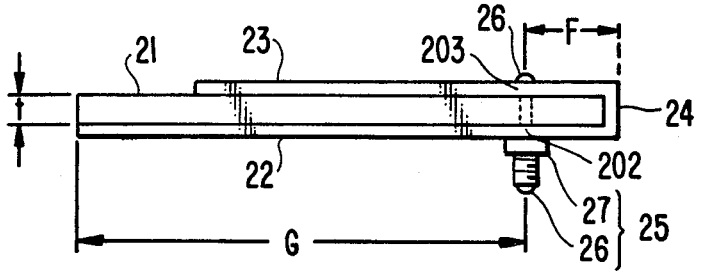

A plan view and a side view of the antenna 10 are shown in FIG. 2. The dielectric substrate 21 is a rectangular plate having a width E and a thickness t and made of a material which has a relative dielectric constant $\epsilon$. The metal film coated on the upper surface of the dielectric substrate 21 is partly removed by etching to form the radiation element 23 having a length D. Reference numerals 202 and 203 show feed points on the ground element 22 and the radiation element 23, respectively. A coaxial connector 25 is mounted on the lower surface of the dielectric substrate 21 at a position coincident with the feed point 202. An outer conductor 27 of the coaxial connector 25 is electrically connected to the ground element at the feed point 202. An inner conductor 26 of the coaxial connector 25 is extended upwardly through the dielectric substrate 21 to reach the radiation element 23 and electrically connected with the radiation element 23 at the feed point 203. A transmission line (not shown) such as a coaxial transmission line can be connected to the coaxial connector 25 to provide an electrical connection from the antenna to a transmitter and/or a receiver (not shown).

The feed point 202 is located at a position apart by a distance F from the end connected with the short-circuit element 24 of the radiation element 23. The feed point 203 is located at a position apart by a distance G from the end opposite to the end connected with the short-circuit element 24 of the ground element 22.

The resonant frequency f of the antenna is approximately given by the following equation:

$$f = \frac{(2N-1)C}{4D\sqrt{\epsilon}}$$

where C is a velocity of light, and N is a natural number. The above equation shows that the resonant frequency f of the antenna is inversely proportional to the length D of the radiation element 23.

Figure 3:
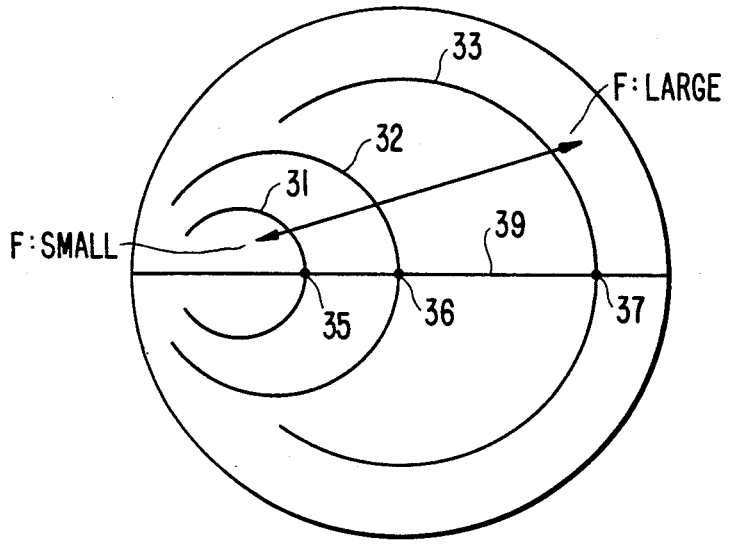
FIG. 3 is a graph showing the locus of the complex input impedance as a function of frequency on a Smith Chart of the embodiment of FIG. 1.

FIG. 3 shows the complex input impedance at the feed point 203 as a function of frequency on a Smith Chart normalized to 50 Ω. Curves 31, 32 and 33 represent a change of the complex impedance locus as a function of the distance F. The resistive impedances 35, 36 and 37 are represented as the impedances at the points where curves 31, 32 and 33 intersect the zero-impedance line 39, respectively. As shown in FIG. 3, the resistive impedance increases with the increase of the distance F, and is zero when the feed point 203 is located on the short-circuit element 24. Therefore, the distance F is determined so as to match the impedance of the antenna to the coaxial transmission line characteristic impedance, i.e. 50 Ω in this case.

The distance G in FIG. 2 is selected to be electrically an odd multiple of one-quarter wavelength of a signal to be transmitted, namely $G=(2n-1)\cdot\lambda/4$, where λ is the wavelength of signal to be transmitted and n is a positive integer. If the distance G is selected in this manner, the voltage of the standing voltage wave induced on the ground element 22 becomes minimum at the feed point 202, and therefore the parastic current induced on the outer conductor of the coaxial transmission line is remarkably reduced. The width E and the thickness t of the antenna may be determined freely, but it is noted that the gain can be increased by increasing the width E and the thickness t. The length D of the radiation element 23 may preferably be electrically an odd multiple of one-quarter wavelength so as to radiate electromagnetic energy efficiently. Each of the feed points 202 and 203 may be located at any position in the widthwise direction.

Figure 4:
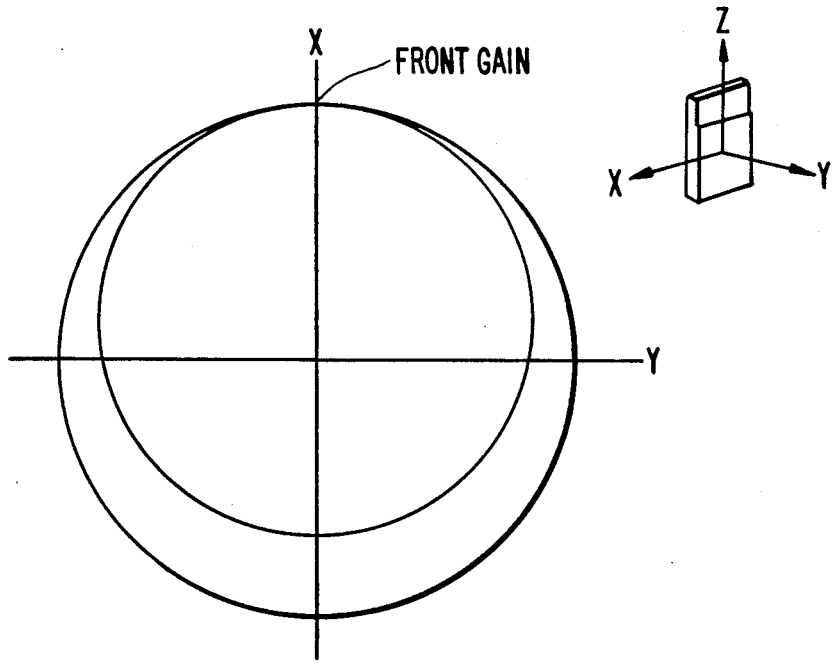
FIG. 4 is a graph showing a radiation pattern of the embodiment of FIG. 1.

FIG. 4 shows an example of radiation pattern of the antenna according to the invention under the condition of N=1, f=930 MHz, D=48 mm, E=50 mm, F=11 mm, G=55 mm and t=1.6 mm. The dielectric substrate 21 is a polytetrafluoroethylene substrate reinforced with a glass fiber cloth with a relative dielectric constant ε of about 2.6 and a relative permeability μ of about 1.0. The thickness of each copper layer is about 35 μm. As shown in FIG. 4, the antenna provides a nearly omnidirectional radiation pattern in the horizontal plane. The front gain of at least −2 dBd can be obtained. The front gain will increase with the increase of the width E and the thickness t. Also, the input impedance and gain characteristic of the antenna will not change easily even if an electric circuit which may be electrically connected to the antenna or a human body is accessed very close to the ground element 22.

Figure 5A:
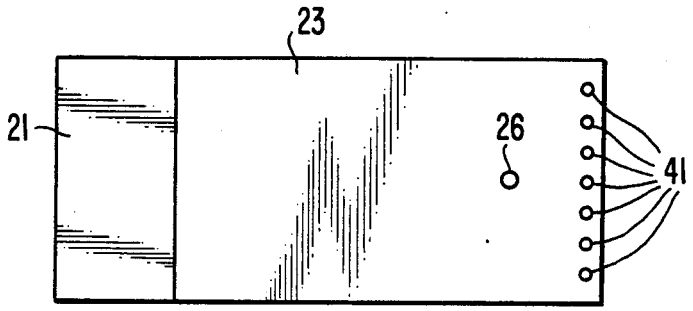
FIG. 5 shows a plan view and a side view of another embodiment of an antenna according to the present invention, having conductive short-circuit pins.
Figure 5B:
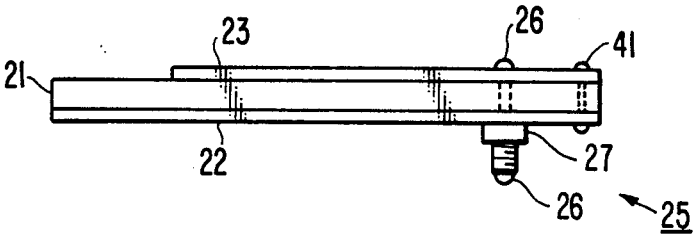

FIG. 5 shows another embodiment of the present invention. Referring to FIG. 5, a plurality of conductive pins 41 are used as the short-circuit element instead of the single metal film used in the FIG. 2 embodiment. The antenna shown in FIG. 5 has almost the same characteristics as those of the antenna shown in FIG. 2. Instead of the plurality of conductive pins 41, a plurality of via holes which are coated on their inner surfaces with conductive layers may be used as the short-circuit element.

Figure 6A:
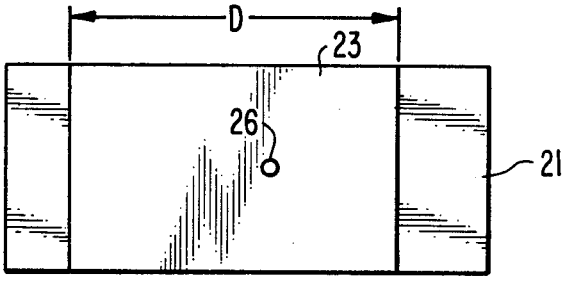
FIG. 6 shows a plan view and a side view of still another embodiment of an antenna according to the present invention.
Figure 6B:
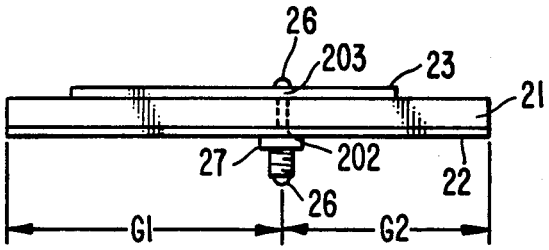

FIG. 6 shows still another embodiment of the present invention. The antenna shown in FIG. 6 has no short-circuit element which connects the radiation element 23 and the ground element 22. The resonant frequency f of the antenna is approximately given by the following equation:

$$f=\frac{NC}{2D\sqrt{\epsilon}}$$

where C is a velocity of light, N is a natural number, D is a length of the radiation element 23, and ε is a relative dielectric constant of the dielectric substrate 21.

In the FIG. 6 embodiment, the feed point 202 on the ground element 22 is placed at a position which is apart by a distance G1 from one end of the ground element 22 and by a distance G2 from the other end of the ground element 22 in the longitudinal direction of the antenna. Each of the distances G1 and G2 is selected to be electrically an odd multiple of one-quarter wavelength of signal to be transmitted so that the voltage of the standing voltage wave induced on the ground element 22 becomes minimum at the feed point 202. The length D of the radiation element 23 may preferably be selected to be electrically one-half wavelength so as to radiate electromagnetic energy efficiently.

Although the antenna according to the invention can be made in any size for general applications, it is noted its structure is particularly advantageous to be configured as a small antenna used for portable radio equipment. More specifically, if the area of each major surface of the dielectric substrate is equal to or smaller than the square of the wavelength ($\lambda^2$), the antenna of the invention is more advantageous than the conventional small antennas.

It should be also understood that the above described embodiments are only for the understanding of the invention, but not to limit the scope of the invention. Various changes and modifications may be made without departing from the scope of the invention defined in the appended claims.

What is claimed is:

1. An antenna comprising:

a dielectric substrate;

a radiation element provided on one major surface of said dielectric substrate;

a ground element provided on another major surface opposite to said one major surface of said dielectric substrate;

a first feed means provided at a first feed point on said radiation element for electrically connecting said radiation element with a signal line of a transmission line; and second feed means provided at a second feed point on said ground element for electrically connecting said ground element to a ground line of said transmission line, wherein a voltage applied between said signal and ground lines of said transmission line induces a standing voltage wave on said ground element and wherein said second feed point is located at a position where a voltage of said standing voltage wave induced on said ground element is a minimum.

2. An antenna according to claim 1, wherein each of said radiation element and said ground element is rectangular in shape.

3. An antenna according to claim 2, wherein said second feed point is apart from one end of said ground element by electrically an odd multiple of one-quarter wavelength of a signal to be transmitted and from the other end opposite to said one end of said ground element by electrically another odd multiple of one-quarter wavelength of the signal to be transmitted.

4. An antenna according to claim 3, wherein the electrical length of said radiation element is one-hhlf wavelength of the signal to be transmitted.

5. An antenna comprising:

a dielectric substrate;

a radiation element provided on one major surface of said dielectric substrate;

a ground element provided on another major surface opposite to said one major surface of said dielectric substrate;

a short-circuit means provided at or near an end of said dielectric element for electrically connecting said radiation element and said ground element;

a first feed means provided at a first feed point on said radiation element for electrically connecting said radiation element with a signal line of a transmission line; and second feed means provided at a second feed point on said ground element for electrically connecting said ground element to a ground line of said transmission line, wherein a voltage applied between said signal and ground lines of said transmission line induces a standing voltage wave on said ground element and wherein said second feed point is located at a position where a voltage of said standing voltage wave induced on said ground element is a minimum.

6. An antenna according to claim 5, wherein each of said radiation element and said ground element is rectangular in shape.

7. An antenna according to claim 6, wherein said second feed point is apart from an end opposite to an end connected with said short-circuit means of said ground element by electrically an odd multiple of one-quarter wavelength of a signal to be transmitted.

8. An antenna according to claim 7, wherein the electrical length of said radiation element is one-quarter wavelength of the signal to be transmitted.

9. An antenna according to claim 5, wherein said short-circuit means comprises a single conductive film coated on said side surface of said dielectric substrate.

10. An antenna according to claim 5, wherein said short-circuit means comprises a plurality of conductive pins provided near the end of said dielectric substrate.

11. An antenna according to claim 5, wherein said first feed point is located at a position where an input impedance of said antenna is matched to a characteristic impedance of said transmission line.

12. An antenna comprising:

a dielectric substrate having rectangular major surfaces opposite to each other;

a radiation element comprising a conductive film coated on one major surface of said dielectric substrate;

a ground element comprising a conductive film coated on another major surface of said dielectric substrate;

a short-circuit means for electrically connecting an end of said radiation element and a respective end of said ground element;

a first feed means provided at a first feed point on said radiation element for electrically connecting said radiation element with a signal line of a transmission line; and a second feed means provided at a second feed point on said ground element for electrically connecting said ground element with a ground line of said transmission line, said second feed point being apart from an end opposite to said end connected with said short-circuit element of said ground element by electrically an odd multiple of one-quarter wavelength of a signal to be transmitted.

13. An antenna according to claim 12, wherein said short-circuit means comprises a conductive film coated on one side surface of said dielectric substrate.

14. An antenna according to claim 12, wherein said short-circuit means comprises a plurality of conductive pins provided along one side of said dielectric substrate.

15. An antenna according to claim 12, wherein the electrical length of said radiation element is one-quarter wavelength of the signal to be transmitted.

16. An antenna according to claim 12, wherein said first feed point is located at a position where an input impedance of said antenna is matched to a characteristic impedance of said transmission line.

* * * * *